US005839822A

United States Patent [19]

Oechsle

[11] Patent Number: 5,839,822

[45] Date of Patent: Nov. 24, 1998

[54] SPOTLIGHTS

[76] Inventor: Walter Oechsle, 2 Halcyon Dr., Glen Waverley 3150, Australia

[21] Appl. No.: 611,889

[22] Filed: Mar. 6, 1996

Related U.S. Application Data

[63] Continuation-in-part of Ser. No. 507,207, Jul. 26, 1995, abandoned.

[30] Foreign Application Priority Data

Sep. 7, 1994 [AU] Australia ..... 71669
Jan. 17, 1996 [AU] Australia ..... 42011/96

[51] Int. Cl.[6] ..... F21V 29/00

[52] U.S. Cl. ..... 362/264; 362/265; 362/267; 362/310

[58] Field of Search ..... 362/264, 265, 362/267, 310, 226

[56] References Cited

U.S. PATENT DOCUMENTS

| | | | |
|---|---|---|---|
| 3,551,667 | 12/1970 | Husby et al. | 362/226 |
| 5,015,917 | 5/1991 | Nigg | 362/264 |
| 5,077,695 | 12/1991 | Khuri-Yakub et al. | 362/265 |
| 5,351,174 | 9/1994 | Ewing | 362/226 |
| 5,390,096 | 2/1995 | DeKleine et al. | 362/264 |

OTHER PUBLICATIONS

Brochure, WOTAN, "Brillant Bright Tungsten–Hologan Light Holo Star".

Technical Information, Dept. MKAB/A, Ed. Mar. 90, Subject to Change Without Notice, HALOLUX, Mains Voltage Single–Ended Tungsten Halogen Lamps: 220/230V or 240/250V, Jun. 28, 1995, OSRAM Australia, p. 25.

Technical Information, Dept. MKAB/A, Ed. Mar. 90, Subject to Change Without Notice, HALOLUX, Mains Voltage Double–Ended Tungsten Halogen Lamps: 220/230V or 240/250V, Jun. 28, 1995, OSRAM Australia, p. 28.

Brochure, OSRAM, Tungsten Halogen Lamps, pp. 1–15.

ATCO, Section G: Transformers Retrofit Transformer Connection, AMT Transformer Connection, 1 page.

Australian Application No. 584,520, "Improved Spotlight Arrangement", Ernest James Pavelin, (Complete Specification), pp. 1a–7, FIGS. 1–3, Mar. 1989.

*Primary Examiner*—Alfred Basichas

[57] ABSTRACT

A low-voltage spotlight for use in substitution for a mains voltage PAR38 spotlight includes a casing which houses a removable low-voltage halogen lamp and metal reflector and apparatus for stepping down the incoming mains voltage. A lampholder for the removable halogen lamp is mounted on a metal casing which acts as a heat sink and also as a conductor of heat to the outer surface of the casing for dissipation. The spotlight is completely sealed for outdoor use in conjunction with a weatherproof PAR38 lampholder.

17 Claims, 4 Drawing Sheets

SPOTLIGHTS

CROSS-REFERENCE TO RELATED APPLICATION

This application is a continuation-in-part of U.S. application Ser. No. 08/507,207, filed Jul. 26,1995 abandoned.

BACKGROUND OF THE INVENTION

The present invention relates to spotlights and more particularly to a low voltage spotlight which can be used as a replacement for a standard mains voltage PAR38 spotlight for outdoor use. Mains voltage is the supply voltage as provided by the Electricity Supply Authority, typically 110 or 220v 60 Hz USA, 220v 50 Hz Europe, 240v 50 Hz Australia.

There are numerous designs of adaptor lights for halogen lamps available, however, none of them covers a totally sealed compact weatherproof fitting with 50W rating which can be used in a weatherproof PAR38 lampholder and which succeeds in maintaining the critical halogen lamp operating temperatures and levels below those specified by the manufacturers and stipulated in the IEC Standards. The spotlights which are the subject of this invention satisfy these difficult criteria and the term spotlight as used throughout this specification includes within its scope lights which are commonly referred to as floodlights.

A standard mains voltage spotlight widely used throughout the world is the PAR38 which consists of an incandescent light source usually of 120 to 150 watt rating mounted within a sealed glass enclosure. The enclosure is internally metallized to provide a reflective surface which is usually parabolic. The actual shape of the reflective surface will determine the distribution characteristics of the light as will also the design of the transparent glass lens which forms the front face of the light. The light forms a sealed unit and when it fails the entire unit needs to be replaced. The average life of a typical PAR38 light is about 1000 hours. When the light is used in a public place for up to 12 hours a day, making a total of around 4000 hours usage per year, each light will need to be replaced several times a year and for which, in public places such as hotels or tourist resorts where significant numbers of such lights are installed, the annual replacement cost can be substantial. PAR38 lights also present a substantial source of power consumption, when they are used in large numbers. When the lights are installed within a complex which needs to generate its own electricity, for example a tourist resort on an island, the costs of electricity generation can be very substantial with the power consumption needed to run the lights representing a significant portion of the system.

SUMMARY OF THE INVENTION

According to the present invention, there is provided a low-voltage spotlight comprising a weatherproof casing having at a rear end portion a base for engagement within the socket of a mains voltage PAR38 outdoor spotlight and at a forward end portion a removable light-transmitting cover, a metal reflector, and a lampholder for mounting a removable low-voltage light source within the reflector whereby light from the light source is reflected by the reflector through the cover, and means within the casing for reducing the incoming voltage from mains voltage to the required voltage for the light source whereby the low-voltage light can be used in a PAR38 lampholder in substitution for a mains voltage PAR38 spotlight.

BRIEF DESCRIPTION OF THE DRAWINGS

The invention will now be described by way of example, with reference to the accompanying drawings in which.

DETAILED DESCRIPTION OF THE PREFERRED EMBODIMENTS

Figure 1:
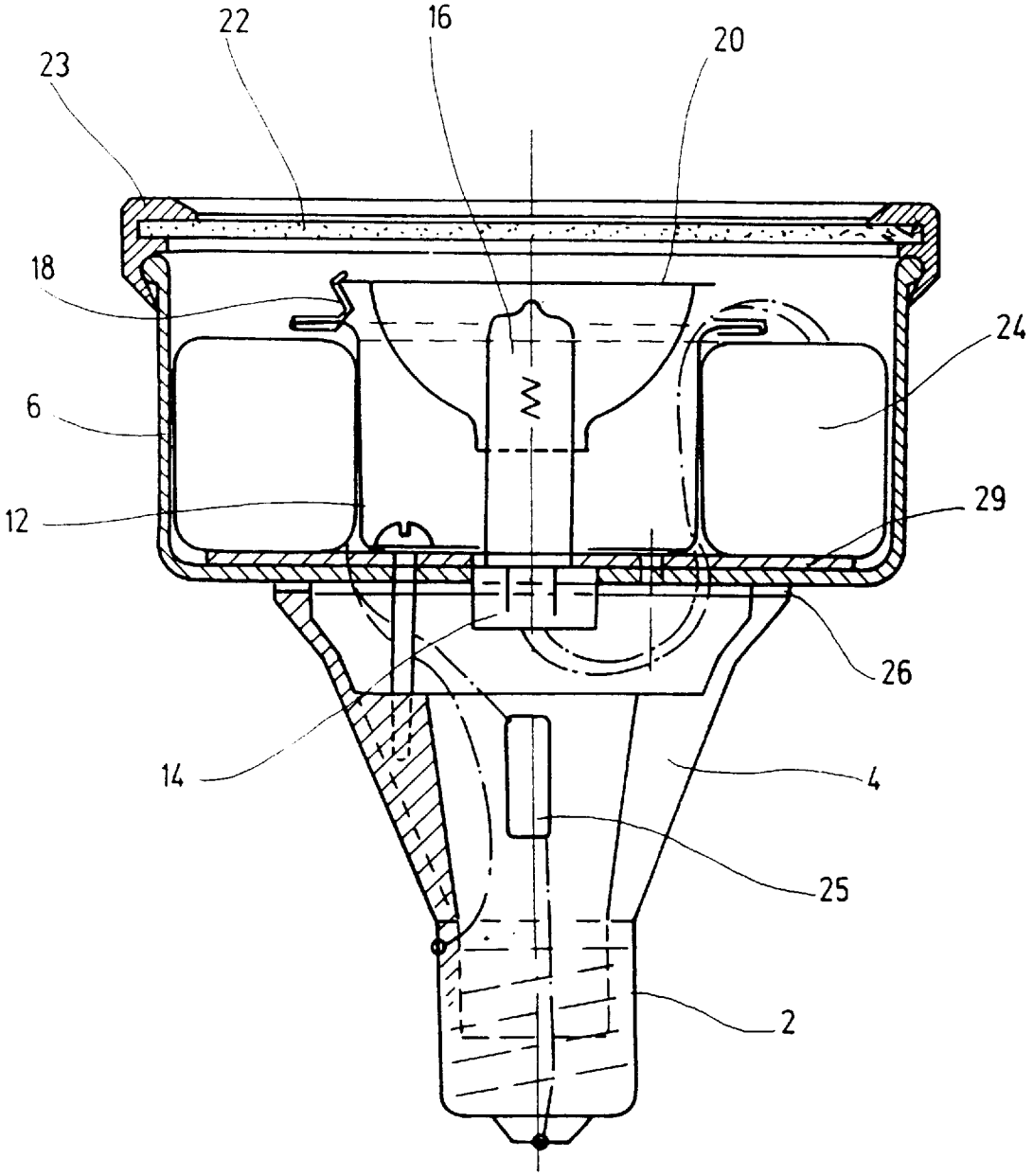
FIG. 1 is a schematic section of a low voltage spotlight in accordance with a first embodiment of the invention using a toroidal transformer.
Figure 2:
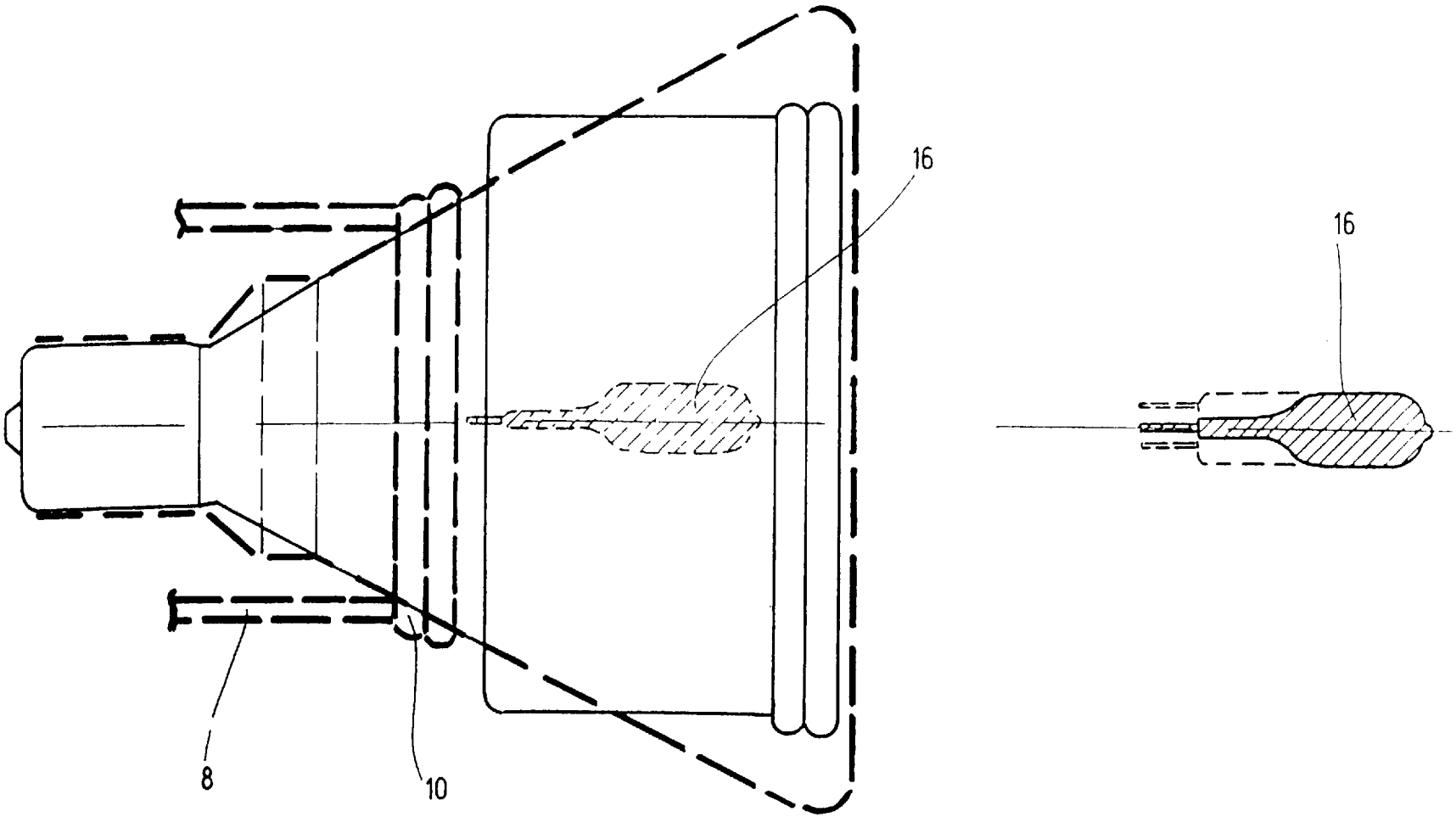
FIG. 2 shows schematically a comparison between the profile of the light of FIG. 1 and the profile of an existing PAR38 spotlight with its lampholder.

In accordance with a preferred embodiment of the present invention as shown in FIGS. 1 and 2, a low voltage light to replace the existing PAR38 light comprises a standard Edison screw base 2 mounted at the inner end of a frustoconical housing 4 which merges into a housing 6 of substantially cylindrical shape. The frustoconical housing 4 is made from suitable UV stabilized plastics and the cylindrical housing 6 from metal. Housings 4 and 6 form the outer casing of the light which is electrically insulated from the base 2 in such a manner that the light is double insulated. The outer profile of the casing from the base 2 to a position adjacent the transition from the frustoconical housing 4 to the cylindrical housing 6 is equivalent to the profile of existing PAR38 lights whereby the light can be fitted into an existing PAR38 lampholder consisting of a tubular socket 8 with an annular seal 10 interposed between the socket and the frustoconical housing to form a weatherproof and dirt proof seal between the light and the socket to prevent ingress of water and dirt into the interior of the lampholder. The equivalence between this portion of the profile of the light and an existing PAR38 light can be seen from FIG. 2 in which the PAR38 light is shown in bold broken lines against the profile of the light. A standard PAR38 lampholder is shown at 8 with the seal being designated at 10.

The base of the cylindrical metal housing 6 carries a lampholder 14 for a replaceable halogen lamp (also known as a halogen burner). The casing is closed at its outer end by a removable lens 22 which is attached to the cylindrical housing 6 by means of an annular peripheral seal 23 which frictionally engages the housing 6 so as to releasably hold the lens 22 to the housing, which also provides a weatherproof and dustproof seal between the lens 22 and housing in order to prevent ingress of moisture and dust into the interior of the light. The lens 22 is removable to provide access to the lamp 16 and reflector 20 to permit replacement of the lamp 16 and also to enable the reflector 20 to be changed in order to vary the light distribution characteristics. The pattern provided on the lens 22 will also affect the light distribution characteristics and it is possible to vary the characteristics by replacing the lens.

The interior of the cylindrical housing 6 houses, behind the reflector 20, a transformer 24 by which the incoming voltage is stepped down to the voltage required for the halogen lamp 16. As shown, the transformer 24 is in the form of a toroidal transformer which can be rated for the temperature within the casing during operation of the light. The transformer 24 is mounted behind reflector 20 with the axis of the transformer being substantially coincident with the longitudinal axis of the light. It is held in position by a metal cup 12 which also forms an annular shield for the transformer from the heat radiated by the lamp and supports the reflector on its rim 3 with equally spaced spring clips 18.

The transformer can be provided with a number of voltage tappings to permit adjustment of the output voltage. It is also fitted with a thermal overload to IEC standards. The tappings are front accessible after removal of the front lens 22.

An inrush current limiter 25 can be fitted in the primary lead from Edison base to transformer.

Figure 3:
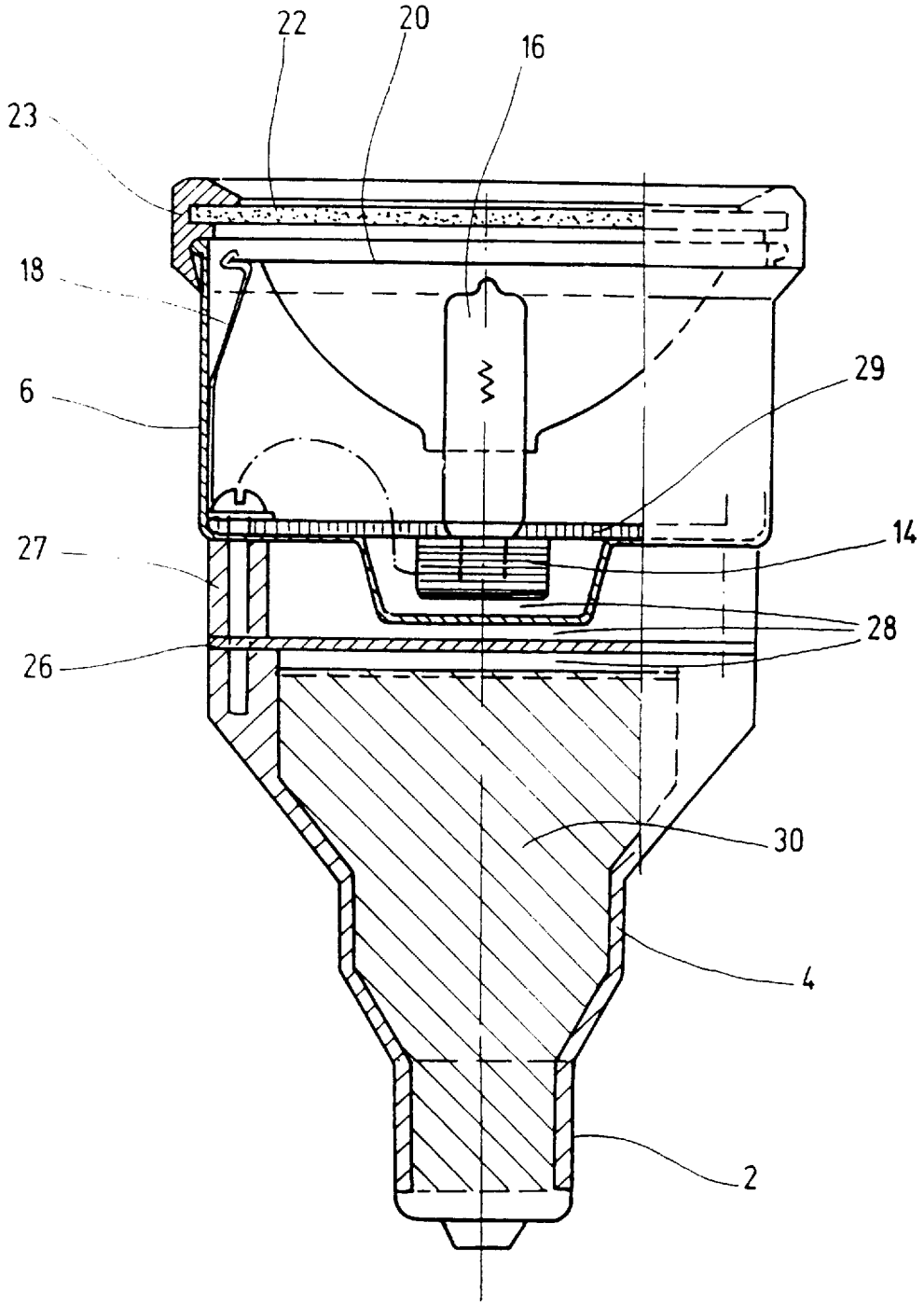
FIG. 3 is a section similar to FIG. 1 but showing a low voltage spotlight in accordance with a second embodiment of the invention using an electronic power supply.

In the embodiment of FIG. 3, instead of using a transformer 24 an electronic power supply 30 which fulfills the same function with precise output voltage, can be fitted behind the housing 6 within the conical housing 4. It has the advantage of low weight but is not as robust as a toroidal transformer and has a shorter service life. It also requires additional thermal insulation against housing 6 which can be achieved by a series of air gaps 28.

As shown in FIG. 3 the general arrangement of the spotlight with electronic power supply 30 is basically the same as the transformer light. However, the heat sensitive electronic unit is accommodated in the conical housing 4 and thermally isolated against the lamp housing 6 by spacers 27 made from heat resistant weatherproof plastics which protect the connecting screws between housings 4 and 6, and provide tunnels for the low voltage wires from power supply to the lampholder. The design incorporates a series of several air gaps 28 between the lampholder and low voltage power supply to achieve adequate thermal insulation.

Typically a halogen lamp suitable for the embodiments of FIGS. 1 and 3 would be 12v 50W, however halogen lamps are available in the range of 6 to 24v with an output from 20 to 150W and could also be used.

In the embodiments described, the metal housing 6 not only serves as support for the lampholder 14 but also has the important function of acting as a heat sink and as a conductor for transferring heat to the outer surface for dissipation. Most of the heat generated by the lamp will be radiated forward from the metal reflector 20 and through the lens 22. However there will be heat built up within the housing behind the reflector 20 as a result of heat conduction and radiation and also to a small degree by the operation of the transformer 24. The heat transfer is determined by the material thickness of the base of housing 6 which for this purpose includes an additional heat sink disc 29 of metal connected to the base. Alternatively the housing 6 is die cast with a base which is thicker than the cylindrical side wall of the housing 6, with the heat sink thus forming an integral part of the casting. The effectiveness of the heat transfer is further influenced by the physical arrangement of lamp, lampholder and heat sink. The lamp and lampholder should be positioned on opposite sides of the heat sink.

The embodiments described are suitable for indoor or outdoor use as they are sealed against ingress of moisture and dust.

The lights described can be used as direct replacement for an existing PAR38 spotlight without any modification to the existing weatherproof lampholder or wiring. The service life of a typical low voltage halogen lamp is around 3000 hours and at the end of its service life it is a simple matter to remove the lens and replace the halogen lamp, the cost of this being considerably less than replacing a standard PAR38 spotlight.

A halogen lamp will have a significantly higher light output than an equivalent incandescent lamp which means that, for a required intensity of illumination, a lower-rated halogen lamp can be used, resulting in reduced power consumption. Savings of more than 50% in power consumption are attainable, which is of considerable commercial significance in situations where on-site power generation occurs. The 50W halogen lamp can replace a 120W PAR38 spotlight. Although fluorescent lamps are more efficient than halogen lamps, they are not suitable as substitutes for spotlights where natural, brilliant light with the full color spectrum is required.

Figure 4:
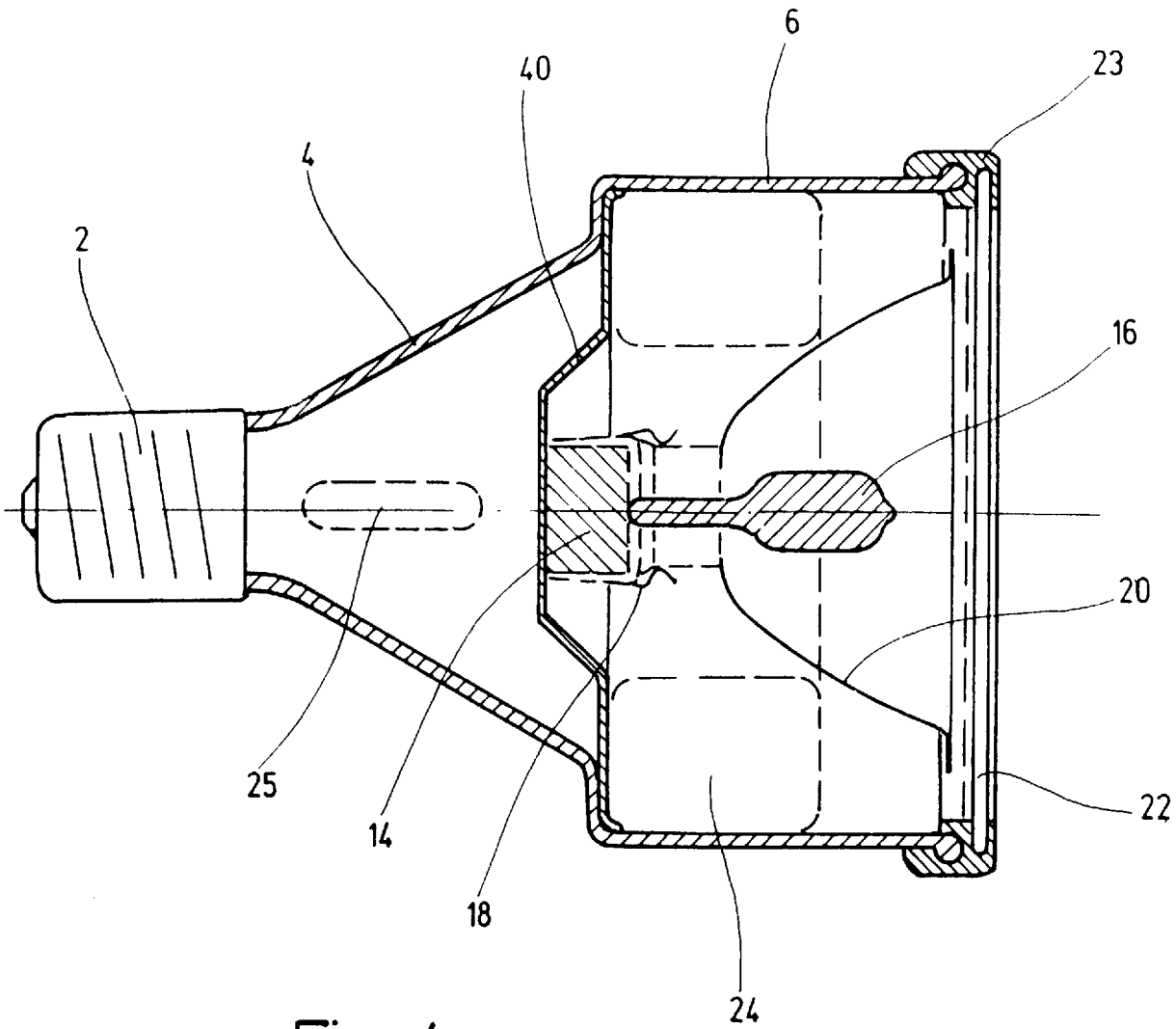
FIG. 4 is a section similar to FIG. 1, but showing a third embodiment for low output applications.

In an alternative embodiment of the invention as shown in FIG. 4, the entire casing is fabricated from suitable plastics whereby the housings 4 and 6 are integrally formed. In this embodiment the base of the housing 6 is formed by a disc or strut 40 of metal which acts as a heat sink and as a thermal conductor for dissipation of heat to the external surface of the casing. This embodiment is suitable primarily only for use with halogen lamps of low output, for example 20W.

The embodiments have been described by way of example only and modifications are possible within the scope of the invention. For example, although the invention has been described with reference to the use of a halogen lamp, other equivalent lamps which provide a brilliant light with the full color spectrum may alternatively be used.

What is claimed is:

1. A low-voltage spotlight comprising:

a weatherproof casing having at a rear end portion a base for engagement within the socket of a mains voltage PAR38 outdoor spotlight and at a forward end portion a removable light-transmitting cover, a metal reflector, and a lampholder for mounting a removable low-voltage halogen light source within the reflector, so that light from the light source is reflected by the reflector through the cover; and means within said weatherproof casing for reducing an incoming voltage to a required voltage for the light source so that the low-voltage halogen light source can be used in a PAR38 lampholder in substitution for a mains voltage PAR38 spotlight.

2. A light according to claim 1, wherein said means for reducing the voltage comprises a toroidal transformer having voltage tappings which permit adjustment of the output voltage based on the incoming mains voltage.

3. A light according to claim 2, wherein said toroidal transformer is mounted behind the reflector, and has an axis substantially coincident with the longitudinal axis of the light, wherein said toroidal transformer surrounds a part of the reflector, further comprising an annular shield to shield said toroidal transformer from heat radiation from the light source.

4. A light according to claim 1, wherein said means for reducing the voltage comprises an electronic unit accommodated in a rear end portion of said weatherproof casing, further comprising thermal insulation interposed between said electronic unit and the lampholder.

5. A light according to claim 4, wherein said thermal insulation comprises a series of air gaps defined in the casing between said electronic unit and the lampholder.

6. A light according to claim 1, wherein the metal reflector is removable from said weatherproof casing.

7. A light according to claim 1, further comprising heat sink apparatus acting as a heat sink and as a conductor for heat from within the light to an outer surface of said weatherproof casing.

8. A light according to claim 7, wherein the light source and the lampholder are positioned on opposite sides of said heat sink apparatus.

9. A light according to claim 1, wherein the forward end portion of said weatherproof casing is formed by a metal housing which carries the cover, the reflector and the lampholder, and wherein a heat sink apparatus is at least partly formed by, or carried by, a base of the metal housing and serves to conduct heat to an external surface of the metal housing for dissipation.

10. A light according to claim 1, wherein the forward end portion of said weatherproof casing is formed of metal and the rear end portion of said weatherproof casing is formed from a plastic portion, wherein the metal forward end portion is attached to a forward end of the plastic portion, and wherein an Edison screw base is attached to a rear end of the plastic portion.

11. A light according to claim 1, wherein the light-transmitting cover is removably attached to the forward end of said weatherproof casing via a weatherproof annular seal which prevents ingress of moisture and dust.

12. A light according to claim 1, wherein the light source provides a brilliant light with a full color spectrum.

13. A spotlight comprising:

a weatherproof casing having a base to engage the socket of a mains voltage PAR38 spotlight and having an end portion including a lampholder for mounting a removable low-voltage light source;

a voltage reduction device within said weatherproof casing to reduce an incoming voltage to a voltage for driving the low-voltage light source when it is coupled to the socket of the mains voltage PAR38 outdoor spotlight; and a heat sink to transfer heat from within the spotlight to an outer surface of said weatherproof casing.

14. A spotlight according to claim 13, wherein said weatherproof casing is formed by a metal housing, and wherein said heat sink is at least partly formed by, or carried by, a base of the metal housing and serves to conduct heat to an external surface of the metal housing for dissipation.

15. A spotlight according to claim 13, wherein said low voltage light source comprises a halogen light source.

16. A low-voltage spotlight comprising:

a weatherproof casing having at a rear end portion a base for engagement within the socket of a mains voltage PAR38 outdoor spotlight and at a forward end portion a removable light-transmitting cover, a metal reflector, and a lampholder for mounting a removable low-voltage light source within the reflector, so that light from the light source is reflected by the reflector through the cover; and means within said weatherproof casing for reducing an incoming voltage to a required voltage for the light source so that the low-voltage light source can be used in a PAR38 lampholder in substitution for a mains voltage PAR38 spotlight; and a heat sink apparatus acting as a heat sink and as a conductor for heat from within the light to an outer surface of said weatherproof casing.

17. A low-voltage spotlight comprising:

a weatherproof casing having at a rear end portion a base for engagement within the socket of a mains voltage PAR38 outdoor spotlight and at a forward end portion a removable light-transmitting cover, a metal reflector, and a lampholder for mounting a removable low-voltage light source within the reflector, so that light from the light source is reflected by the reflector through the cover, said forward end portion of said weatherproof casing being formed by a metal housing which carries the cover, the reflector and the lampholder;

means within said weatherproof casing for reducing an incoming voltage to a required voltage for the light source so that the low-voltage light source can be used in a PAR38 lampholder in substitution for a mains voltage PAR38 spotlight; and a heat sink apparatus being at least partially formed by, or carried by, a base of the metal housing and serving to conduct heat to an external surface of the metal housing for dissipation.

* * * * *